US006000474A

United States Patent [19]

Warnick et al.

[11] Patent Number: 6,000,474

[45] Date of Patent: Dec. 14, 1999

[54] MOBILE HOME FIRE RESPONSE SYSTEM

[76] Inventors: Charles E. Warnick; Peggy Sue Warnick, both of P O Box 314, Greensboro, Pa. 15338

[21] Appl. No.: 09/061,212

[22] Filed: Apr. 16, 1998

[51] Int. Cl.[6] ..... A62C 37/00

[52] U.S. Cl. ..... 169/54; 169/16; 169/62; 239/209

[58] Field of Search ..... 169/54, 62, 37, 169/40, 38, 41; 239/208, 209, 172, 289, 222.11, 222.13, 222.15, 222.17, 225.1, 233, 264, 381, 382, 231; 138/177, 178, DIG. 11

[56] References Cited

U.S. PATENT DOCUMENTS

| | | | |
|---|---|---|---|
| 1,617,415 | 2/1927 | Parsons | 169/54 |
| 3,993,139 | 11/1976 | Vaughn | 169/62 |
| 4,019,581 | 4/1977 | Diggs | 169/41 |
| 4,078,343 | 3/1978 | Moore, Jr. | 169/62 |
| 4,091,876 | 5/1978 | Valdatta | 169/62 |
| 4,151,882 | 5/1979 | Baker et al. | 169/62 |
| 4,168,748 | 9/1979 | Batte | 169/46 |
| 4,372,493 | 2/1983 | Smith | 239/208 |
| 4,453,155 | 6/1984 | Cooper | 340/289 |
| 4,660,766 | 4/1987 | Nelson et al. | 239/222.17 |
| 4,991,657 | 2/1991 | LeLande, Jr. | 169/54 |
| 5,083,618 | 1/1992 | Hayes | 169/54 |
| 5,154,238 | 10/1992 | Buchan | 169/54 |
| 5,263,543 | 11/1993 | Nigro | 169/56 |

*Primary Examiner*—Andres Kashnikow
*Assistant Examiner*—Lisa Ann Douglas

[57] ABSTRACT

A home fire extinguishing system is provided including a sprinkler system having a plurality of sprinkler heads adapted to dispense water in the rooms of a home upon the actuation thereof. Also provided is a manual switch for allowing the selective actuation of the sprinkler system.

9 Claims, 3 Drawing Sheets

MOBILE HOME FIRE RESPONSE SYSTEM

BACKGROUND OF THE INVENTION

1. Field of the Invention

The present invention relates to fire extinguisher systems and more particularly pertains to a new mobile home fire response system for extinguishing a fire within a mobile home and illuminating the same for facilitating a safe exit.

2. Description of the Prior Art

The use of fire extinguisher systems is known in the prior art. More specifically, fire extinguisher systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art fire extinguisher systems include U.S. Pat. No. 3,993,139; U.S. Pat. No. 4,091,876; U.S. Pat. No. Des. 251,128; U.S. Pat. No. 4,453,155; U.S. Pat. No. 5,263,543; and U.S. Pat. No. 5,083,618.

In these respects, the mobile home fire response system according to the present invention substantially departs from the conventional concepts and designs of the prior art, and in so doing provides an apparatus primarily developed for the purpose of extinguishing a fire within a mobile home and illuminating the same for facilitating a safe exit.

SUMMARY OF THE INVENTION

In view of the foregoing disadvantages inherent in the known types of fire extinguisher systems now present in the prior art, the present invention provides a new mobile home fire response system construction wherein the same can be utilized for extinguishing a fire within a mobile home and illuminating the same for facilitating a safe exit.

The general purpose of the present invention, which will be described subsequently in greater detail, is to provide a new mobile home fire response system apparatus and method which has many of the advantages of the fire extinguisher systems mentioned heretofore and many novel features that result in a new mobile home fire response system which is not anticipated, rendered obvious, suggested, or even implied by any of the prior art fire extinguisher systems, either alone or in any combination thereof.

To attain this, the present invention generally comprises a mobile home including an exterior wall having a generally rectangular configuration. A plurality of interior walls are mounted within the exterior wall for defining a plurality of rooms. Note FIG. 5. Also included is a sprinkler system having a longitudinal dispensing pipe of a first diameter mounted to an interior surface of a ceiling of the home. Such longitudinal dispensing pipe is connected to a supply pipe of a second diameter greater than the first diameter. A pump is coupled between the longitudinal dispensing pipe and supply pipe. Such pump is equipped with a first mode of operation for precluding the flow of water to the longitudinal dispensing pipe. In a second mode of operation, the pump is adapted for effecting the flow of water to the longitudinal dispensing pipe at a pressure greater than that at which the water is received from the supply pipe. The longitudinal dispensing pipe of the sprinkler system further includes a plurality of lateral pipes coupled thereto and extended therefrom in perpendicular relationship therewith. Each lateral pipe terminates in a sprinkler head which resides in one of the rooms of the home. Each of such sprinkler heads includes a vertical mounting pipe mounted to an end of the associated lateral pipe. A cylindrical sleeve is rotatably mounted in coaxial relationship with a bottom end of the vertical mounting pipe by way of a plurality of bearings. Also included is an intermediate conduit including a vertically oriented upper extent with a cylindrical configuration. Note FIGS. 1 & 3. Such upper extent of the intermediate conduit is coupled to the sleeve for rotating coincidentally therewith. A slanted middle extent of the intermediate conduit is equipped with a diameter which tapers from top to bottom. A horizontally oriented lower extent with a cylindrical configuration is equipped with an open bottom and a diameter less than that of the upper extent. Each sprinkler head further includes a planar triangular plate coupled to a peripheral side edge of the open bottom of the intermediate conduit. This plate extends in front of the open bottom such that the plate resides in a vertical plane which forms an acute angle with an axis associated with the lower extent of the intermediate conduit. By this structure, upon the receipt of water by the sprinkler heads, the same are adapted to rotate about a vertical axis. Also provided is a plurality of lights each mounted within an upper corner of an associated one of the rooms of the mobile home. Note FIG. 5. Such lights serve to illuminate the associated room when actuated. A smoke detector is mounted within the mobile home and connected between the lights and pump and a power source. The smoke detector serves for actuating the lights and transferring the pump to its second mode operation upon the detection of smoke within the home. Associated therewith is a manual switch mounted within the mobile home and connected between the lights and pump and the power source. In use, the manual switch has a first orientation for maintaining the pump in its first mode operation and the light deactuated. Further, the manual switch has a second orientation for actuating the lights and transferring the pump to its second mode operation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new mobile home fire response system apparatus and method which has many of the advantages of the fire extinguisher systems mentioned heretofore and many novel features that result in a new mobile home fire response system which is not anticipated, rendered obvious, suggested, or even implied by any of the prior art fire extinguisher systems, either alone or in any combination thereof.

It is another object of the present invention to provide a new mobile home fire response system which may be easily and efficiently manufactured and marketed.

It is a further object of the present invention to provide a new mobile home fire response system which is of a durable and reliable construction.

An even further object of the present invention is to provide a new mobile home fire response system which is susceptible of a low cost of manufacture with regard to both materials and labor, and which accordingly is then susceptible of low prices of sale to the consuming public, thereby making such mobile home fire response system economically available to the buying public.

Still yet another object of the present invention is to provide a new mobile home fire response system which provides in the apparatuses and methods of the prior art some of the advantages thereof, while simultaneously overcoming some of the Still another object of the present invention is to provide a new mobile home fire response system for extinguishing a fire within a mobile home and illuminating the same for facilitating a safe exit therefrom.

Even still another object of the present invention is to provide a new mobile home fire response system that includes a sprinkler system having a plurality of sprinkler heads adapted to dispense water in the rooms of a home upon the actuation thereof.

Also provided is a manual switch for allowing the selective actuation of the sprinkler system.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
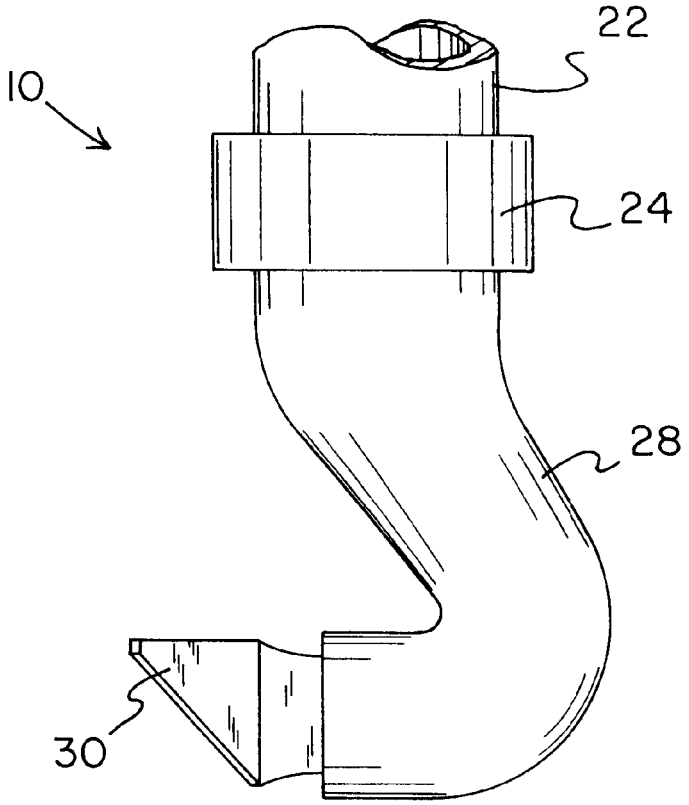
FIG. 1 is a side view of one of the sprinkler heads of the sprinkler system of the present invention.

With reference now to the drawings, and in particular to FIGS. 1 through 5 thereof, a new mobile home fire response system embodying the principles and concepts of the present invention and generally designated by the reference numeral 10 will be described.

The present invention, designated as numeral 10, includes a mobile home 12 including an exterior wall having a generally rectangular configuration. A plurality of interior walls are mounted within the exterior wall for defining a plurality of rooms. Note FIG. 5.

Also included is a sprinkler system 14 having a longitudinal dispensing pipe 16 of a first diameter mounted to an interior surface of a ceiling of the home. Such longitudinal dispensing pipe is connected to a supply pipe of a second diameter greater than the first diameter. A pump 18 is coupled between the longitudinal dispensing pipe and supply pipe. Such pump is equipped with a first mode of operation for precluding the flow of water to the longitudinal dispensing pipe. In a second mode of operation, the pump is adapted for effecting the flow of water to the longitudinal dispensing pipe at a pressure greater than that at which the water is received from the supply pipe.

The longitudinal dispensing pipe of the sprinkler system further includes a plurality of lateral pipes 20 coupled thereto and extended therefrom in perpendicular relationship therewith. Each lateral pipe terminates in a sprinkler head which resides in one of the rooms of the home. To accomplish this, the lateral pipes extend from both sides of the longitudinal dispensing pipe.

Figure 2:
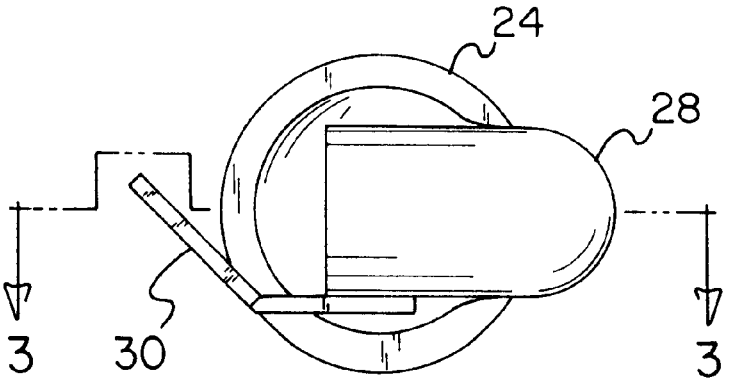
FIG. 2 is a bottom view of one of the sprinkler heads of the present invention.
Figure 3:
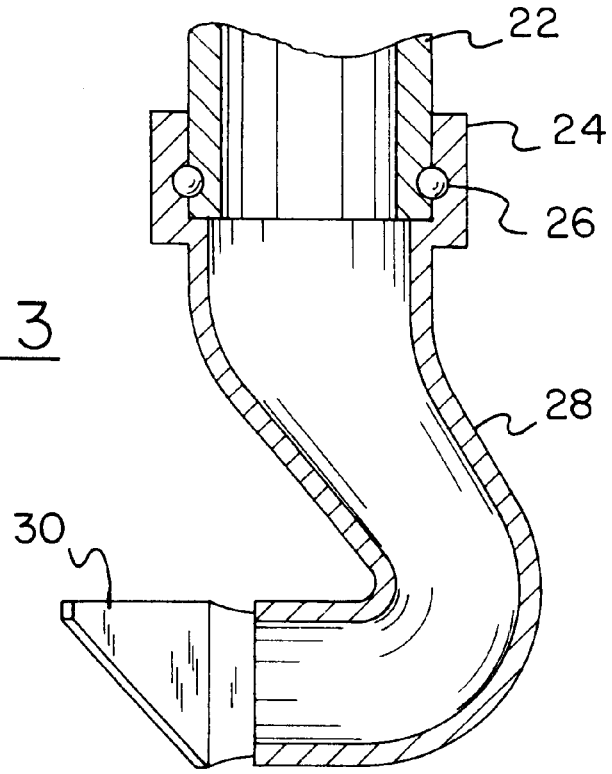
FIG. 3 is a side cross-sectional view of the present invention taken along line 3—3 shown in FIG. 2.
Figure 4:
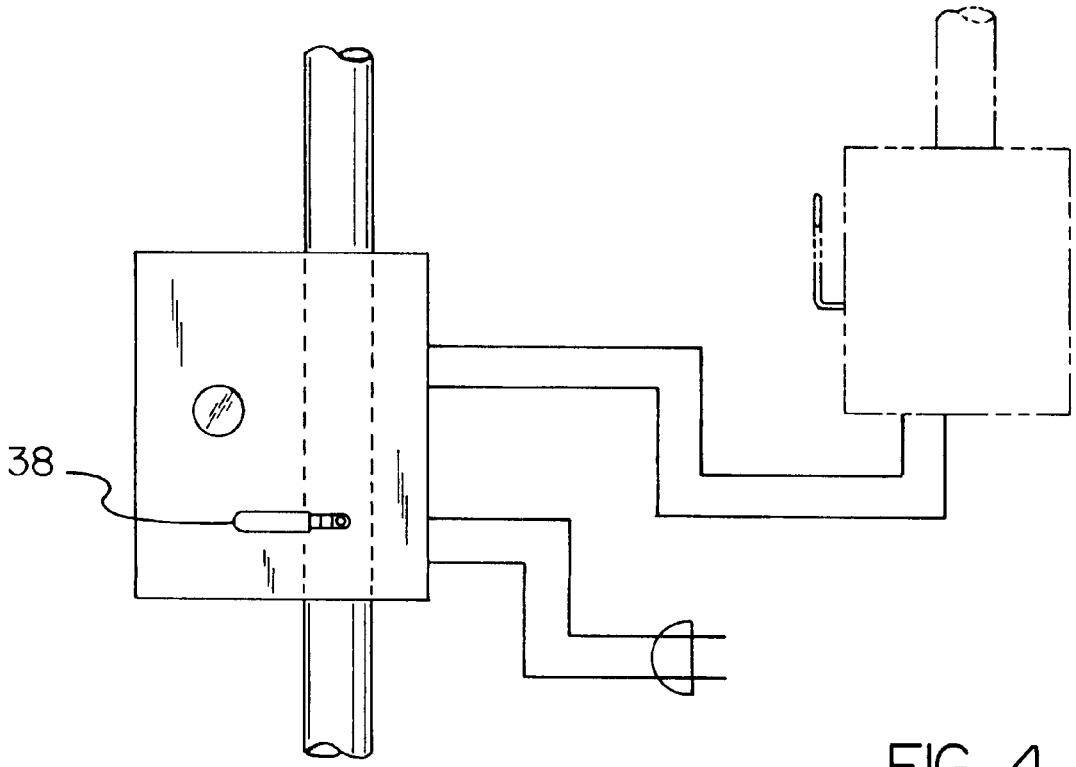
FIG. 4 is a schematic diagram of the various components of the present invention.
Figure 5:
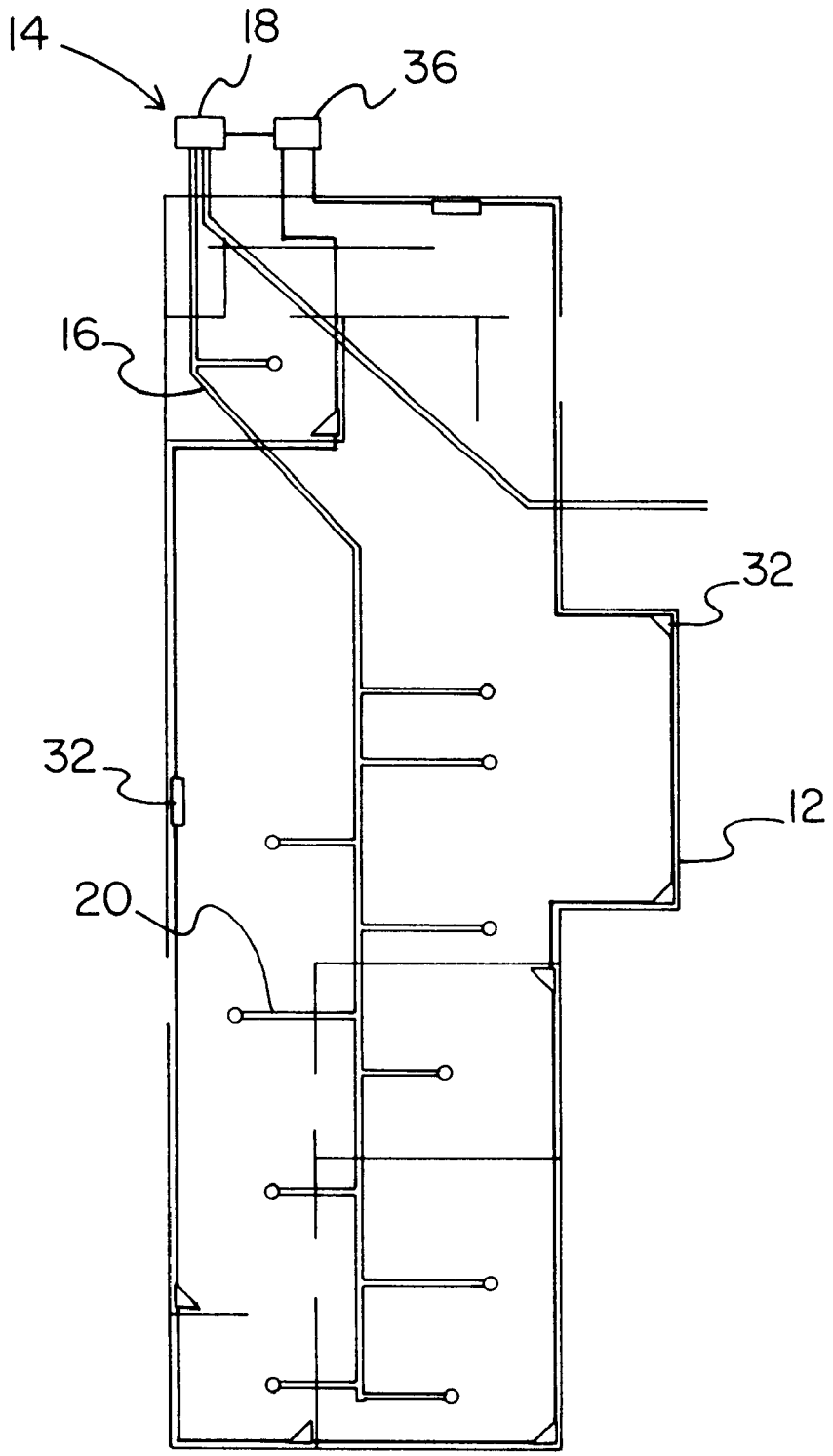
FIG. 5 is a layout of the mobile home in which the present invention is installed.

Each of such sprinkler heads includes a vertical mounting pipe 22 mounted to an end of the associated lateral pipe. A cylindrical sleeve 24 is rotatably mounted in coaxial relationship with a bottom end of the vertical mounting pipe by way of a plurality of bearings 26. Also included is an intermediate conduit 28 including a vertically oriented upper extent with a cylindrical configuration. Note FIGS. 1 & 3. Such upper extent of the intermediate conduit is coupled to the sleeve for rotating coincidentally therewith. A slanted middle extent of the intermediate conduit is equipped with a diameter which tapers from top to bottom. A horizontally oriented lower extent with a cylindrical configuration is equipped with an open bottom and a diameter less than that of the upper extent. As shown in FIGS. 1–3, the lower extent of the intermediate conduit is situated directly below the upper extent.

Each sprinkler head further includes a planar triangular plate 30 coupled to a peripheral side edge of the open bottom of the intermediate conduit. This plate extends in front of the open bottom such that the plate resides in a vertical plane which forms an acute angle with an axis associated with the lower extent of the intermediate conduit. By this structure, upon the receipt of water by the sprinkler heads, the same are adapted to rotate about a vertical axis.

Also provided is a plurality of lights 32 each mounted within an upper corner of an associated one of the rooms of the mobile home. Note FIG. 5. The lights may also be situated along an interior surface of the exterior wall in larger rooms. Such lights serve to illuminate the associated room when actuated.

A smoke detector is mounted within the mobile home and connected between the lights, pump and a power source.

Such power source preferably includes not only a conventional alternating current receptacle, but also a back up power generator 36. The smoke detector serves for actuating the lights and transferring the pump to its second mode operation upon the detection of smoke within the home. Associated therewith is a manual switch 38 mounted within the mobile home and connected between the lights, pump and the power source. In use, the manual switch has a first orientation for maintaining the pump in its first mode operation and the light deactuated. Further, the manual switch has a second orientation for actuating the lights and transferring the pump to its second mode operation. As such, the present invention may be manually activated independent of the operation of the smoke detector.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A mobile home fire extinguishing system comprising, in combination:

a mobile home including an exterior wall having a generally rectangular configuration and a plurality of interior walls mounted within the exterior wall for defining a plurality of rooms;

a sprinkler system including a longitudinal dispensing pipe of a first diameter mounted to an interior surface of a ceiling of the home, the longitudinal dispensing pipe connected to a supply pipe of a second diameter greater than the first diameter wherein a pump is coupled therebetween with a first mode of operation for precluding the flow of water to the longitudinal dispensing pipe and a second mode of operation for effecting the flow of water thereto at a pressure greater than that at which the water is received from the supply pipe, the longitudinal dispensing pipe having a plurality of lateral pipes coupled thereto and extending therefrom in perpendicular relationship therewith, wherein each lateral pipe terminates in a sprinkler head which resides in one of the rooms of the home;

said sprinkler heads each including a vertical mounting pipe mounted to an end of the associated lateral pipe, a cylindrical sleeve rotatably mounted in coaxial relationship with a bottom end of the vertical mounting pipe by way of a plurality of bearings, and an intermediate conduit including a vertically oriented upper extent with a cylindrical configuration coupled to the sleeve for rotating coincidentally therewith, a slanted middle extent with a diameter which tapers from top to bottom, and a horizontally oriented lower extent with a cylindrical configuration and an open bottom and diameter less than that of the upper extent, each sprinkler head further including a planar triangular plate coupled to a peripheral side edge of the open bottom of the intermediate conduit and extending in front of the open bottom such that the plate resides in a vertical plane which forms an acute angle with an axis associated with the lower extent of the intermediate conduit, whereby upon the receipt of water by the sprinkler heads, the same are adapted to rotate;

a plurality of lights each mounted within an upper corner of an associated one of the rooms of the mobile home and adapted to illuminate the associated room when actuated;

a smoke detector mounted within the mobile home and connected between the lights and pump and a power source for actuating the lights and transferring the pump to its second mode operation upon the detection of smoke within the home; and a manual switch mounted within the mobile home and connected between the lights and pump and the power source, the manual switch having a first orientation for maintaining the pump in its first mode operation and the light deactuated, the manual switch further having a second orientation for actuating the lights and transferring the pump to its second mode operation.

2. A home fire extinguishing system comprising:

a home including an exterior wall and a plurality of interior walls mounted within the exterior wall for defining a plurality of rooms;

a sprinkler system including a plurality of sprinkler heads adapted to dispense water in one of the rooms upon the actuation thereof, the sprinkler heads each have a plate coupled adjacent to an open end of the sprinkler head for forming an acute angle therewith;

a manual switch for allowing the selective actuation of the sprinkler system.

3. A home fire extinguishing system as set forth in claim 2 wherein the sprinkler system includes a pump for supplying the sprinkler heads with water having a pressure greater than that received from a water supply pipe.

4. A home fire extinguishing system as set forth in claim 2 and further including a plurality of lights for illuminating the home upon the actuation of the sprinkler system.

5. A home fire extinguishing system as set forth in claim 2 wherein each sprinkler head is mounted on a pipe of a diameter which is less than that of a water supply pipe through which the water is supplied.

6. A home fire extinguishing system as set forth in claim 2 and further including a smoke detector for actuating the sprinkler system upon the detection of smoke.

7. A home fire extinguishing system as set forth in claim 2 wherein each sprinkler head has a rotating intermediate conduit with a tapering diameter.

8. A home fire extinguishing system as set forth in claim 2 wherein each sprinkler head has a horizontal lower extent and a vertical upper extent.

9. A home fire extinguishing system comprising:

a home including an exterior wall and a plurality of interior walls mounted within the exterior wall for defining a plurality of rooms; and a sprinkler system including a plurality of sprinkler heads adapted to dispense water in one of the rooms upon the actuation thereof;

wherein the sprinkler heads each have a plate coupled adjacent to an open end thereof for forming an acute angle therewith.